US011805910B2

(12) United States Patent
Fischer

(10) Patent No.: US 11,805,910 B2
(45) Date of Patent: Nov. 7, 2023

(54) LOCKING DEVICE FOR FURNITURE, ROTATABLE FURNITURE AND METHOD FOR LOCKING A ROTATABLE FURNITURE

(71) Applicant: Sedus Stoll AG, Dogern (DE)

(72) Inventor: Harry Fischer, Degernau (DE)

(73) Assignee: SEDUS STOLL AG, Dogern (DE)

( * ) Notice: Subject to any disclaimer, the term of this patent is extended or adjusted under 35 U.S.C. 154(b) by 133 days.

(21) Appl. No.: 17/464,641

(22) Filed: Sep. 1, 2021

(65) Prior Publication Data

US 2022/0175143 A1 Jun. 9, 2022

(30) Foreign Application Priority Data

Dec. 4, 2020 (DE) ..... 102020007392.1

(51) Int. Cl.
*A47C 3/18* (2006.01)
*A47C 7/60* (2006.01)

(52) U.S. Cl.
CPC . *A47C 3/18* (2013.01); *A47C 7/60* (2013.01)

(58) Field of Classification Search
CPC .. A47C 7/60; A47C 3/18; A47C 7/002; B60N 2002/022
See application file for complete search history.

(56) References Cited

U.S. PATENT DOCUMENTS 1,399,464 A * 12/1921 Collier ..... A47C 3/18 248/161
5,599,065 A * 2/1997 Gryp ..... A47C 3/18 297/344.21
2004/0066074 A1* 4/2004 Ovitt ..... A47C 3/18 297/344.21

(Continued)

FOREIGN PATENT DOCUMENTS

DE 31 27 625 A1 6/1982
JP 2007007010 A 1/2007

OTHER PUBLICATIONS

European Search Report for German Patent Application Serial No. 201185188.6 (dated Jan. 12, 2022).

(Continued)

*Primary Examiner* — Milton Nelson, Jr.
(74) *Attorney, Agent, or Firm* — Jenkins, Taylor & Hunt P.A.

(57) ABSTRACT

A locking device for furniture, in particular for furniture which may be adjusted by rotation of a furniture section is provided. The locking device includes an axle which is rotatable for adjusting the furniture and which has an engagement recess limited to an angular segment about the axle. The locking device further includes a blocking element which is configured for rotational blocking of the axle by engaging in the engagement recess. The locking device further includes a support bearing which is configured to support the blocking element in a fixed rotational manner about the axle. The locking device further includes an adjusting ring rotating about the axle, which has a contoured recess for radial adjustment of the blocking element within the support bearing upon rotation of the adjusting ring about the axle. The blocking element is engageable in the engagement recess by the radial adjustment, so that the axle is lockable rotationally with the support bearing via the blocking element.

19 Claims, 4 Drawing Sheets

(56) References Cited

U.S. PATENT DOCUMENTS

| | | | | |
|---|---|---|---|---|
| 2007/0052271 | A1* | 3/2007 | Lin | A61G 5/1072<br>297/344.22 |
| 2011/0193390 | A1* | 8/2011 | Hsiao | B60N 2/146<br>297/344.22 |

OTHER PUBLICATIONS

Office Action for German Patent Application Serial No. DE 10 2020 007 392.1 (dated Jul. 6, 2021).

* cited by examiner

LOCKING DEVICE FOR FURNITURE, ROTATABLE FURNITURE AND METHOD FOR LOCKING A ROTATABLE FURNITURE

PRIORITY CLAIM

This application claims the priority benefit of German Patent Application Number 10 2020 007 392.1, filed Dec. 4, 2020, the disclosure of which is incorporated herein by reference in its entirety.

FIELD OF INVENTION

The present invention relates to a locking device for furniture, in particular for furniture adjustable by rotation of a furniture section, a rotatable furniture, in particular a swivel armchair, and a method for locking a rotatable furniture.

BACKGROUND

Rotatable furniture is generally known for all-purpose applications such as desk or work chairs. Such applications also exist in the lounge environment, for example for swivel chairs.

However, there is also furniture for specific applications which, due to their specific design, are generally not rotatable and cannot be used universally. Other uses are usually not possible, or at least not possible without disassembly.

One example of such specific applications is furniture for racing simulations, also known as "sim racing". These include a fixed seat and a device for mounting a racing simulation steering wheel and a racing simulation pedal set. In most cases, rigid metal frames, also known as "rigs", are used for this purpose, to which the seat, the racing simulation steering wheel and the racing simulation pedals are attached. Disadvantageously, such specific furniture is usually very space-consuming.

SUMMARY OF THE INVENTION

One of the ideas of the present invention to provide a locking device for furniture as well as an improved rotatable furniture which, in particular, allows a configuration of a furniture both for all-purpose applications, for example for living or working spaces, and a configuration for a specific application.

Accordingly, there is provided:

A locking device for furniture, in particular for furniture which are adjustable by rotation of a furniture section, comprising: an axle which is rotatable for adjusting the furniture and which has an engagement recess limited to a predetermined angular segment about the axle; a blocking element which is configured for rotational blocking of the axle by engaging in the engagement recess; a support bearing which is configured to support the blocking element in a fixed rotational manner about the axle; and an adjusting ring rotating about the axle, which has a contoured recess for radial adjustment of the blocking element within the support bearing upon rotation of the adjusting ring about the axle, wherein the blocking element is engageable in the engagement recess by the radial adjustment, so that the axle is lockable rotationally with the support bearing by means of the blocking element.

A rotatable furniture, in particular a swivel chair, comprising: a pedestal; a useful section, in particular a seat; and a locking device according to the invention, which couples the pedestal and the useful section by means of the axle and the support bearing of the locking device, wherein the useful section is rotatable about the axle and lockable in a predetermined orientation relative to the pedestal by means of the locking device.

A method for locking a furniture which is adjustable by rotating a furniture section, in particular a rotatable furniture according to the invention and/or having a locking device according to the invention, comprising the method steps: releasing the rotatability of an adjusting ring arranged about an axle of the rotatable furniture; and locking a blocking element, which is adjustable radially to the axle with a contoured recess of the adjusting ring, with an engagement recess, which is provided on the axle and is limited to a predetermined angular segment about the axle, by rotating the adjusting ring about the axle.

The present invention is based on the principle that—for an all-purpose use as well as a use for specific applications—, a rotatable furniture would have to be rotatable for an all-purpose use on the one hand and lockable for a use in the specific application on the other hand.

The idea underlying the present invention is to provide a locking device for furniture which is suitable for implementing rotatability and lockability, and which has a rotatable axle, and provides for engagement of blocking elements, which are adjustable by means of an adjusting ring, and are additionally mounted in a support bearing, in engagement recesses provided on the axle. According to the invention, a contoured recess is provided in the adjusting ring for adjusting the blocking elements, which converts a rotation of the adjusting ring into a radial translation of the blocking element. Thereby, a free rotatability is provided in a released configuration, and a high stability is provided in a locked configuration, thereby providing a very simple switchability between the locked and the rotatable configuration.

For example, such a locking device according to the invention may be used for locking the rotating column of a seat, in particular of a rotatable armchair or chair. Such a locking device is useful, for example, for aligning a seat in a predetermined direction or with respect to a predetermined second object. Thereby, some embodiments of the present invention are applicable in the field of multifunctional furniture, which is—in a first configuration—generally rotatable and usable, for example, as lounge or living room furniture, and which is—in a second configuration—locked and usable, for example, as sim-racing furniture. In particular, the seat may thus be aligned in a predetermined manner with respect to a second multifunctional furniture which, in a predetermined configuration, exposes a racing simulation steering wheel and a racing simulation pedal gallery towards the seat.

It is understood that an engagement recess which is limited to a predetermined angular segment around the axle may be an engagement recess in the axle intended for a determination of the rotational degree of freedom, which is configured to establish a tight fit and/or friction fit with the blocking element in the direction of rotation. A definition of a translational degree of freedom, for example in the axial direction, may also be provided, however it is not necessary.

It is understood that a blocking element is an engagement element which corresponds to the engagement recess, which is configured to engage in the engagement recess to establish a positive and/or frictional connection, so that the axle is prevented from rotating.

It is understood that a support bearing is a guide of the blocking element which permits a radial movement of the blocking element but blocks a rotational movement of the blocking element, and in some embodiments blocks it in a form-fitting manner.

Advantageous embodiments and further improvements are apparent from the further dependent claims as well as from the description with reference to the figures of the drawing.

In accordance with an embodiment, the adjusting ring is configured to be rotatable in a spring-biased manner for radial adjustment of the blocking element in the direction of the axle. Thereby, the blocking element is independently lockable with the engagement recess by the spring-biased rotation of the adjusting ring when the blocking element and the engagement recess are in alignment with each other. Advantageously, operation is thus greatly improved, because as soon as the adjusting ring is released for rotation, the blocking element independently engages in the engagement recess in the predetermined position. In particular, the rotatable furniture section thus only needs to be rotated for locking, wherein it is locked in the predetermined orientation by the locking device.

In accordance with an embodiment, the contoured recess of the adjusting ring has an opening oriented towards the axle, through which the blocking element is engageable in the engagement recess at the level of the adjusting ring when the opening and the engagement recess are in register with each other. This is particularly advantageous if the blocking element also extends at the level of the adjusting ring, and also engages in the axle at this level. Advantageously, the engagement surface may be enlarged thereby, and thus the surface pressure and point load on the blocking element and the engagement recess may be reduced, so that a higher load capacity of the locking device is provided without increased constructional complexity.

In accordance with an embodiment, the blocking element is formed as a round bolt which is received in the support bearing substantially parallel to the axle. Furthermore, the engagement recess is formed as a round groove inserted into a lateral surface of the axle. Thereby, the blocking element may be configured to have a simple geometry, which on the one hand simplifies manufacture, and on the other hand facilitates compatibility. In addition, this enables smooth and less jerky engagement, since the round surfaces may fit smoothly against each other during engagement.

According to a further development, a radius of the round bolt corresponds to a radius of the round groove wherein the round bolt is configured to be insertable into the round groove over its entire length with a section of its lateral surface. In some embodiments, the adjusting ring or its contoured recess has a self-locking section by means of which the blocking element, if located in this section, is held within the engagement recess. Thus, despite the round shape of the round bolt and the round groove, a tight fit is established between them, which prevents rotation of the axle.

In further embodiments, for example, one or more balls may also be provided as a blocking element. Thereby, the installation space required for the locking device is reduced. The engagement recess may also be formed as a round groove or, in one embodiment, as a pocket in the shape of a ball section.

In accordance with an embodiment, a plurality of engagement recesses, blocking elements, support bearings and contoured recesses of the adjusting ring arranged around the circumference of the axle are provided for radial adjustment of the blocking elements within the support bearings during rotation of the adjusting ring. Thereby, the locking action is provided at several points distributed around the circumference of the axle, so that on the one hand the load or a moment of resistance of the locking device is increased, and on the other hand a distribution of the load is provided which prevents jamming of the blocking elements.

In accordance with an embodiment, the arrangement of the plurality of engagement recesses, blocking elements, support bearings and contoured recesses is asymmetrically distributed around the circumference of the axle, wherein only a single position is provided in which all blocking elements and the corresponding engagement recesses are in alignment with each other, so that the blocking elements may only be inserted into the engagement recesses in this position by rotation of the adjusting ring. Thereby, a predetermined position of the axle relative to the support bearing is defined, in which locking is possible. In other positions, however, the axle of the locking device remains rotatable and only engages with the blocking elements when the predetermined position is reached.

According to a further embodiment of a rotatable furniture, the furniture has an actuating element which is configured to control the rotation and/or the rotatability of the adjusting ring. In particular, the actuating element is an adjusting lever, which in some embodiments is a manually operable adjusting lever. For example, in one embodiment, the actuating lever may adjust the adjusting ring directly against the spring bias, i.e. release the locking device, or release it for spring-biased rotation, i.e. locking, depending on its position.

In further embodiments, however, a permanent coupling of the actuating element with the adjusting ring may also be conceivable, for example in the manner of a dead center mechanism, which holds the adjusting lever in a set (locked or released) end position.

In accordance with an embodiment, the adjusting ring of the locking device is configured to be rotatable in a spring-biased manner for radial adjustment of the blocking element in the direction of the axle, and a retaining device coupled to the actuating element is provided for selective control of the spring-biased rotatability of the adjusting ring. Thereby, the adjusting ring may be controlled with the actuating element without being in constant engagement therewith. In particular, in intermediate positions of the adjusting ring, in which it is neither retained in a released position nor in a locked position, no engagement of the adjusting ring with the actuating element is provided. Thereby, on the one hand, the force required for actuation may be reduced and, on the other hand, jamming and also incorrect actuations by applying a force which is too high or too low may be avoided.

In accordance with an embodiment, in a first position of the actuating element the adjusting ring is released for radial displacement of the blocking element by the spring-biased rotation, and in a second position of the actuating element the retaining device blocks the adjusting ring against the spring bias in a position holding the blocking element out of engagement. Advantageously, thereby only restoring and retaining forces are applied by a user, however those forces for locking the locking device are applied independently of a user input, but only by the spring bias. Thereby, incorrect operation by applying a force which is too high or too low is advantageously prevented.

In accordance with an embodiment of the method for locking a furniture that may be adjusted by rotation of a furniture section, the blocking element is rotationally supported about the axle by a support bearing, so that a rotational blocking of the axle with the support bearing is established by the locking. Thereby, for example, a pedestal coupled to the furniture section by means of the locking device is lockable with the rotatable furniture section. For this purpose, the support bearing is attached to the pedestal.

In accordance with an embodiment of the method, the adjusting ring is spring-biased in order to rotate independently. Furthermore, the blocking element and the engagement recess are brought into engagement with each other by independent rotation of the adjusting ring as soon as they are in register with each other. Thereby, the locking is provided only in a predetermined position in which the register is achieved, so that automatic latching is enabled only in this predetermined position.

In accordance with an embodiment of the method, the latching establishes a locking between a useful section rotatable about the axle and a pedestal of the furniture, wherein the useful section has an actuating element, in particular an adjusting lever, with which the rotatability of the adjusting ring is released. Thereby, the furniture standing on the pedestal may be freely rotated about the pedestal in the released position, and may be locked in a predetermined orientation in the locked position.

The above embodiments and further implementations may be combined with each other as desired, if useful. In particular, all features of the locking device are transferable to the furniture and the locking method, and vice versa. Further possible embodiments, improvements and implementations of the invention also comprise not explicitly mentioned combinations of features of the invention described above or below with respect to the embodiments. In particular, the skilled person will thereby also add single aspects as improvements or additions to the respective basic form of the present invention.

BRIEF DESCRIPTION OF THE DRAWINGS

The present invention will be explained in more detail hereinafter with reference to the exemplary embodiments stated in the schematic figures of the drawing, wherein.

Figure 1A:
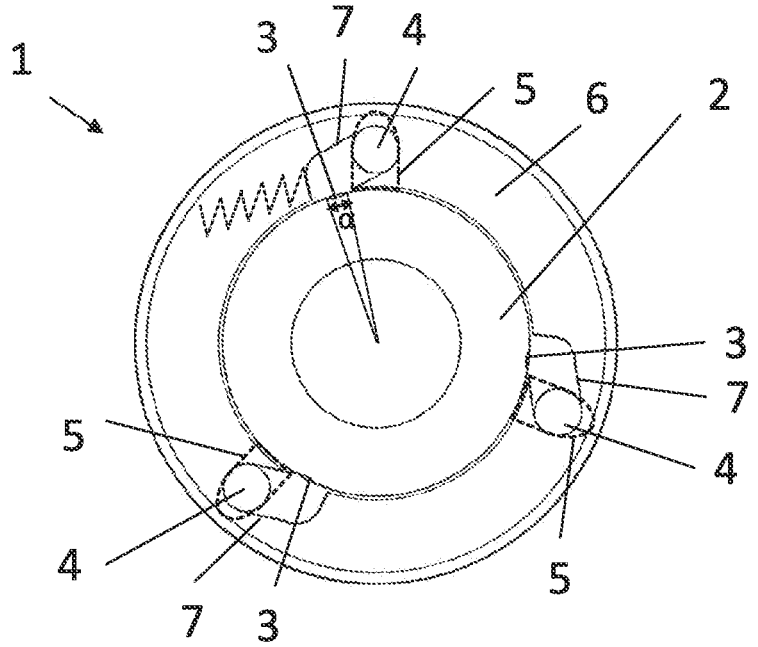
FIG. 1A shows a locking device in a released position.

The attached figures of the drawing shall convey a further understanding of the embodiments of the invention. They illustrate embodiments and in connection with the description serve the explanation of the principles and concepts of the invention. Other embodiments and many of the stated advantages are apparent in view of the drawings. The elements of the drawings are not necessarily shown true to scale with regard to each other.

In the figures of the drawing the same, functionally same or equally acting elements, features and components are, unless otherwise stated, respectively provided with the same reference numerals.

DETAILED DESCRIPTION OF EMBODIMENTS

FIG. 1A shows a locking device 1 in a released position.

The locking device 1 is configured for furniture and serves in particular for the lockability of furniture that may be adjusted by rotating a furniture section. For this purpose, the locking device 1 has a rotatable axle 2 for adjusting the furniture, which axle has an engagement recess 3. The engagement recess 3 is limited in its extension to a predetermined angular segment a around the axle 2, which in this case is configured in the form of an axially extending groove.

Furthermore, a blocking element 4 corresponding to the engagement recess 3 is provided, which is configured to rotationally lock the axle 2 by engaging in the engagement recess 3.

In the embodiment shown, there is a plurality of, here specifically by way of example, three engagement recesses 3 and blocking elements 4, respectively. However, only one element or another plurality of elements is of course also conceivable in further embodiments.

For supporting the blocking element 4, a support bearing 5 is also provided, which supports the blocking element 4 in a rotationally fixed manner about the axle 2, but allows radial movement of the blocking element 4. This is a concealed support bearing which may be configured, for example, as a support ring. The support bearing 5 has radially extending grooves marked as covered edges with dashed lines, in which the blocking element 4 is guided in the radial direction and fixed in the circumferential direction. In further embodiments, other types of support bearing would of course also be possible, for example in the form of a guide rail guiding a corresponding blocking element exclusively in a linear manner, or the like.

In addition to the support bearing 5, an adjusting ring 6 is provided which rotates around the axle 2 and has a contoured recess 7 for radial adjustment of the blocking element 4 within the support bearing 5 when the adjusting ring 6 rotates around the axle 2. The contoured recess runs obliquely, at least in portions, so that the blocking element 4 running in the recess is adjusted in the radial direction when the adjusting ring rotates. The blocking element 4 is thus guided in two different elements, firstly the support bearing 5, which determines its positions in the circumferential direction, and secondly the adjusting ring 6, which serves to convert the rotation into a radial adjustment.

If the radial adjustment is sufficiently large, the blocking element 4 is engageable in the engagement recess 3 of the axle so that the axle 2 is lockable in rotation by means of the blocking element 4 with the support bearing 5. For this purpose, the shape of the contoured recess 7 is adapted to the geometry of the blocking element 4 and the engagement recess 3, so that in a first position, as shown in FIG. 1A, the blocking element 4 is safely out of engagement with the axle 2. Furthermore, a second position exists in which the blocking element 4 is securely engaged with the axle 2 or the engagement recess 3, so that the locking device 1 assumes a locked position.

Figure 1B:
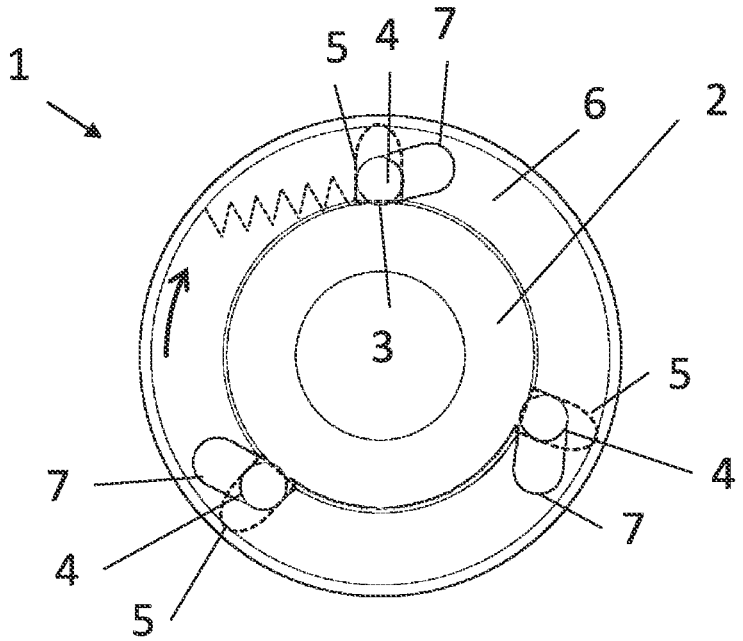
FIG. 1B shows the locking device of FIG. 1A in a locked position.

FIG. 1B shows the locking device 1 of FIG. 1A in a locked position.

In this locked position, the blocking element 4 engages in the engagement recess 3 so that a tight fit is established between the axle 2 and the support bearing 5. Depending on the geometry and design, this can alternatively or additionally also be a frictional connection. Furthermore, a self-locking section may be provided in the contoured recess 7 to secure the positive locking, which is configured in such a way that the adjusting ring 6 cannot be turned back by restoring forces of the blocking element 4 in the second position shown.

Furthermore, in the embodiment shown, the adjusting ring 6 is configured to be spring-preloaded rotatable for radial adjustment of the blocking element 4 in the direction of the axle 2. As indicated here by dashed lines as an example, a spiral spring may be provided for this purpose, which independently presses the adjusting ring from the first position of FIG. 1 A into the second position of FIG. 1B. The spiral spring may, for example, be attached to the blocking element 4 in the direction of the axle 2. For this purpose, the spiral spring may be supported, for example, on a shoulder of the support bearing not shown in more detail here. In other embodiments, other spring preloads are also conceivable, for example by means of a torsion spring or the like.

Due to the spring-biased rotation of the adjusting ring 6, the blocking element 4 may be independently locked with the engagement recess 3 when the blocking element 4 and the engagement recess 3 are in register with each other, as is the case shown in FIG. 1B. If the blocking element 4 is not in register with the engagement recess 3, as is shown in FIG. 1A, for example, the blocking element 4 cannot engage in the engagement recess. The axle 2 must then be rotated for locking so that the blocking element 4 is arranged in register with the engagement recess 3, as shown in FIG. 1B.

In the embodiment shown, a plurality of engagement recesses 3, blocking elements 4, support bearings 5 and contoured recesses 7 of the adjusting ring are provided around the circumference of the axle 2 for radial adjustment of the blocking elements 4 within the support bearings 5 upon rotation of the adjusting ring 6. The blocking elements may thus only engage simultaneously in the engagement recesses 3. Consequently, this is only possible if all blocking elements are also arranged in alignment with the engagement recesses. Furthermore, the arrangement of the plurality of engagement recesses 3, blocking elements 4, support bearings 5 and contoured recesses 7 is arranged asymmetrically distributed around the circumference of the axle 2. Thus, only a single position is provided in which all blocking elements 4 and the corresponding engagement recesses 3 are in register with each other, so that the blocking elements 4 may be inserted into the engagement recesses 3 by rotation of the adjusting ring 6 only in this position.

The blocking elements 4 may be generally various blocking elements that may be guided by the described guide in several components and are configured for engagement with the engagement recesses, and may also be, in addition to round bolts, for example, balls or the like.

Figure 2A:
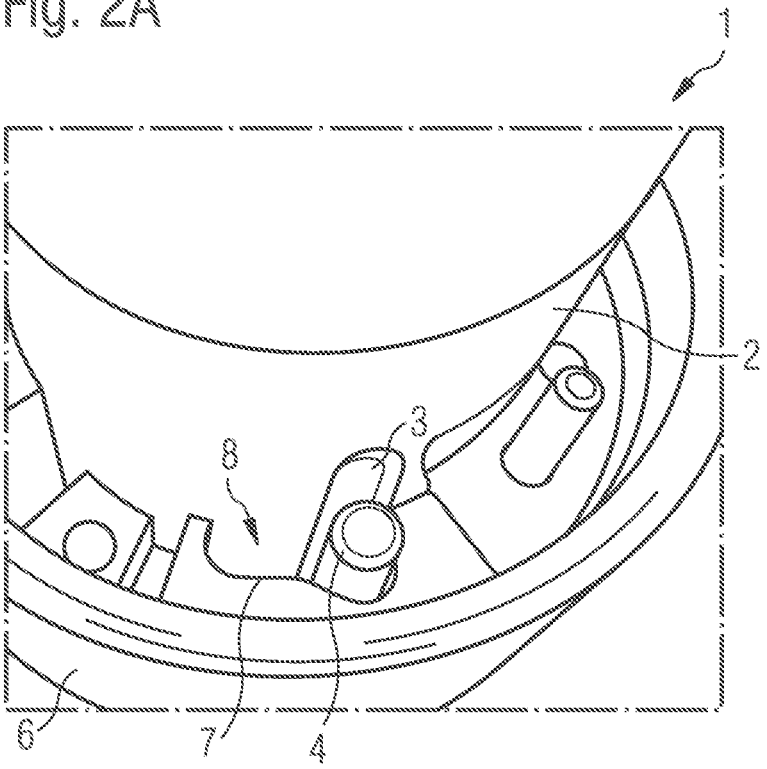
FIG. 2A shows a perspective view of a section of a locking device according to a further embodiment in a released position.

FIG. 2A shows a perspective view of a portion of a locking device 1 according to a further embodiment in a released position.

In this embodiment, the blocking element 4 is formed as a round bolt accommodated in the support bearing 5 substantially parallel to the axle 2, and the engagement recess 3 is formed as a round groove introduced into a lateral surface of the axle 2. A radius of the round bolt corresponds to a radius of the round groove, and the round bolt may be inserted into the round groove over its entire length with a portion of its lateral surface. In the first position shown here, which qualitatively corresponds to a first position of FIG. 1A, in which the round bolt is separated from the round groove, the round bolt is completely accommodated in the contoured recess 7.

Figure 2B:
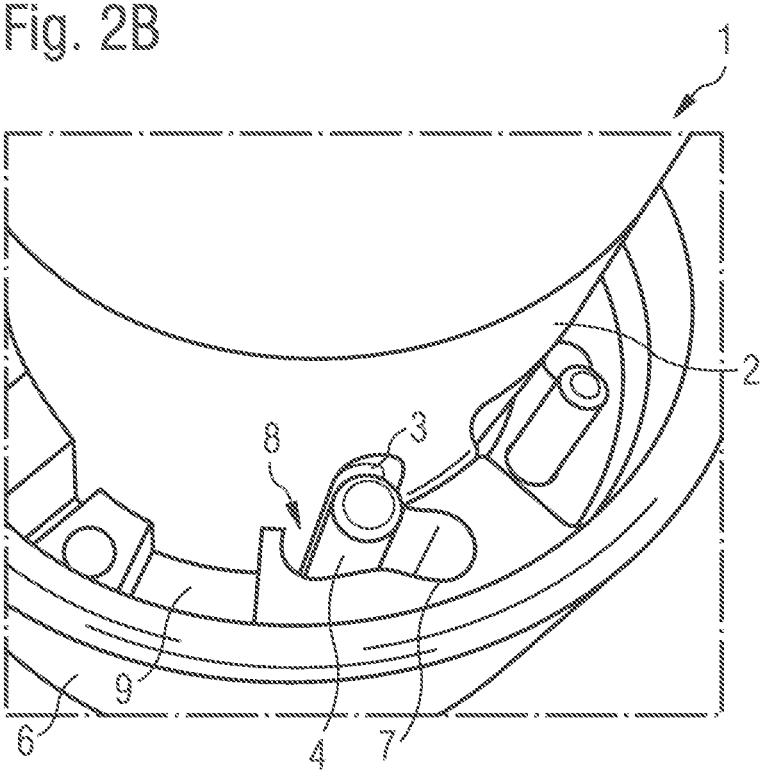
FIG. 2B shows the locking device of FIG. 2A in a locked position.

FIG. 2B shows the locking device of FIG. 2A in a locked position.

In the locked position, the round bolt is supported on one side of its lateral surface by the contoured recess 7 and inserted into the engagement recess 3 on the other side. For this purpose, the contoured recess 7 of the adjusting ring 6 has an opening 8 oriented towards the axle 2, through which the blocking element 4 or, in this case, the round bolt is engageable in the engagement recess 3 at the level of the adjusting ring 6 when the opening 8 and the engagement recess 3 are in register with each other. In the region of the opening 8, a self-locking portion is provided in the contoured recess 7 to secure the tight fit, which portion supports the circumferential surface of the round bolt and does not run obliquely but in the circumferential direction, so that the adjusting ring 6 in the second position shown cannot be turned back by restoring forces of the blocking element 4.

FIGS. 2A and 2B also show a bearing ring 9 arranged below the adjusting ring 6, in which radially extending guides for the round bolt are provided, concealed here by the adjusting ring and configured as support bearings 5, corresponding to the dashed lines shown in FIG. 1A.

Furthermore, the adjusting ring 6 and the bearing ring 9 have projections engaging into each other which allow a predefined relative movement of the two rings 6, 9 to each other, and also limit them within a predefined range. Furthermore, a spring may also be clamped between the projections of the bearing ring and the adjusting ring, which causes a spring-biased rotation of the adjusting ring 6 relative to the bearing ring 9, as already explained with reference to FIG. 1. As an example, this may be a helical spring, as shown in FIG. 1, however a spiral spring, a torsion spring or another elastic element suitable for spring pretensioning are also conceivable.

The locking device 1 shown here is also configured for use with a rotatable furniture, for example a swivel chair.

Figure 3A:
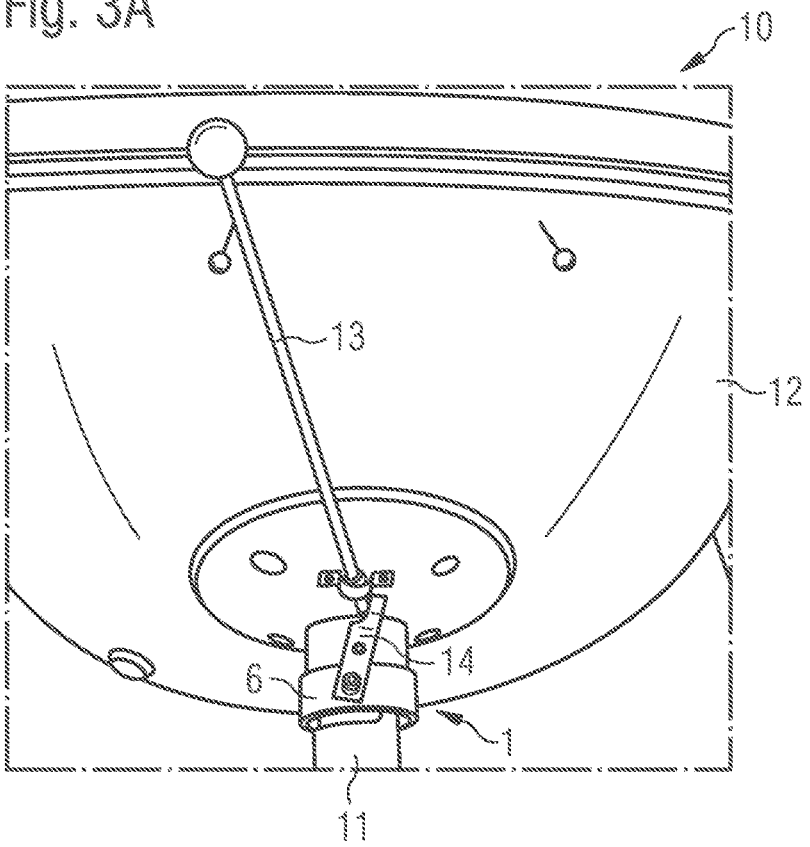
FIG. 3A shows a rotatable furniture in a released position.

FIG. 3A shows a rotatable furniture 10 in a released position.

The rotatable furniture 10 shown here is, by way of example, a swivel armchair which has a central column forming a pedestal 11. Furthermore, a useful section 12 is provided in the form of a seat of the swivel chair.

The useful section 12 and the pedestal 11 are connected by means of the locking device 1 shown in FIG. 2, which locking device 1 couples the pedestal 11 and the useful section 12 by means of the axle 2 and the support bearing 5. Accordingly, the useful section 12 is provided rotatable relative to the pedestal about the axle 2 by means of the locking device 1 and lockable in a predetermined orientation.

For controlling the rotatability of the adjusting ring 6, the furniture 10 has an actuating element 13, here exemplarily in the form of an adjusting lever. In the illustrated released position of the locking device 1, the actuating element 13 holds the adjusting ring 6 spring-biased in a position separating the blocking elements 4 from the axle 2 or the engagement recesses 3, as shown in FIG. 2A. For this purpose, a retaining device 14 coupled to the actuating element 13 is provided for selectively controlling the spring-biased rotatability of the adjusting ring 6, which will be discussed in more detail with reference to FIG. 4.

By manually adjusting the actuating element 13, in this case by manually adjusting the adjusting lever, the adjusting ring 6 is released so that it may be adjusted by its spring bias to independently reach a locked position as shown in FIG. 2B.

Figure 3B:
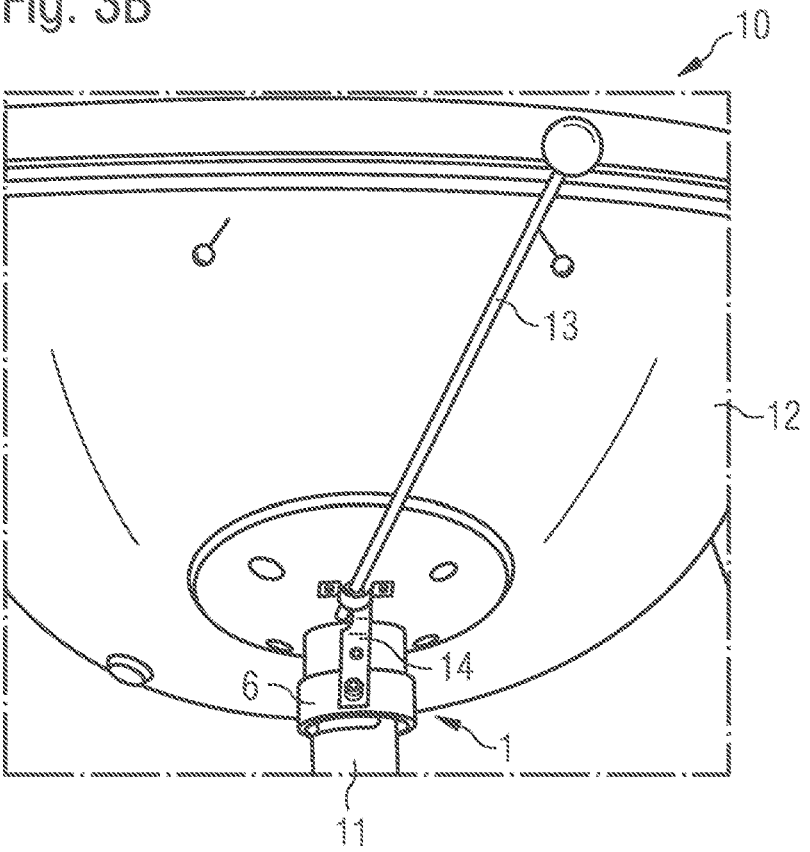
FIG. 3B shows the rotatable furniture of FIG. 3A in a locked position.

FIG. 3B shows the rotatable furniture 10 of FIG. 3A in a locked position.

In this position, the adjusting ring 6 has independently rotated about the axle 2 by the spring bias relative to the support bearing 5 of the locking device 1, so that the blocking elements 4 engage in the engagement recesses 3 of the axle 2. With the rotation of the adjusting ring 6, the retaining device 14 has also readjusted and is again in contact with the actuating element 13 in the locked position shown.

The useful section 12, which is configured as a seat, is now locked with respect to the pedestal or column, i.e. it can no longer be rotated about the axle 2. Thereby, the swivel chair is oriented in a predetermined position. Advantageously, the swivel chair may thus be oriented in a predetermined desired manner in the locked position, and may always be locked again in this predetermined desired orientation once it has been released, provided that the pedestal is not manipulated.

The locked position may be released accordingly by opposing actuation of the actuating element 13. Such opposing actuation rotates the adjusting ring back into the released position shown in FIG. 3A.

Accordingly, a method for locking the rotatable furniture 10 adjustable by rotation of a furniture section, in particular a useful section 12, may be carried out. A first step of the method comprises releasing the rotatability of the adjusting ring 6 arranged around the axle 2 of the rotatable furniture 10. A further step comprises engaging the blocking element 4, which is adjustable with the contoured recess 7 of the adjusting ring 6 radially with respect to the axle 2, with the engagement recess 3 provided on the axle 2 and limited to a predetermined angular segment a around the axle by rotating the adjusting ring 6 around the axle 2.

When the blocking element 4 engages in the engagement recess, the blocking element 4 is rotationally supported with the support bearing 5 about the axle 2, so that a rotational blocking of the axle 2 with the support bearing 5 is established by the engagement.

The adjusting ring 6 is spring-biased to rotate independently such that the adjusting ring is locked upon release. Thus, after the release of the adjusting ring 6, the blocking element 4 and the engagement recess 3 are brought into engagement with each other by independent rotation of the adjusting ring 6 as soon as they come into alignment with each other. Thereby, the locking in particular creates a locking between a useful section 12, which may be rotated about the axle 2, and a pedestal 11 of the furniture 10. The release of the adjusting ring 6 takes place by means of an actuating element 13 provided on the useful section 12, which is configured here, for example, in the form of an adjusting lever, with which the rotatability of the adjusting ring 6 is released. For this purpose, a retaining device coupled to the actuating element 13 and the adjusting ring is released when the actuating element 13 is actuated.

Figure 4:
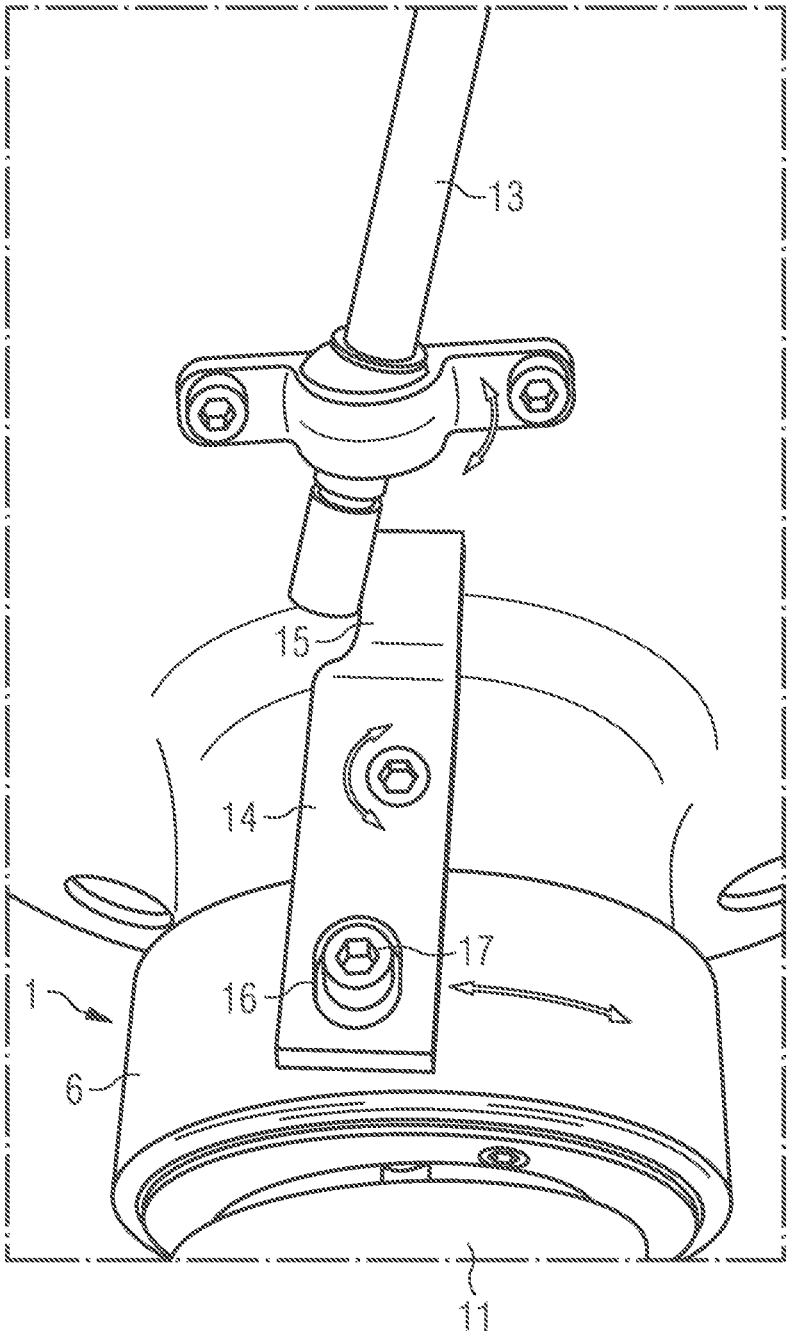
FIG. 4 shows a detailed view of a retaining device coupled to an actuating element.

FIG. 4 shows a detailed view of a retaining device 14 which is coupled to an actuating element 13.

The retaining device 14 is configured in such a way that, in a first position of the actuating element 13, it releases the adjusting ring 6 for radial adjustment of the blocking element 4 by the spring-biased rotation, and, in a second position of the actuating element 13, it blocks the adjusting ring 6 against the spring bias in a position holding the blocking element 4 out of engagement. The retaining device is configured in this case, by way of example, as a transmission in the form of a rotatable lever which is rotatably mounted centrally. For the rotatable mounting, a rotational axle formed with a screw is provided in this case, which is fixed to the useful section 12 of the furniture 10.

At the upper end thereof, the retaining device 14 has a contact section 15, which is configured to contact the actuating element 13. At this contact section, the actuating forces are transmitted from the actuating element 13 to the retaining device 14, which result in the spring-biased retention of the adjusting ring 6 or in the resetting of the adjusting ring 6 against the spring force.

On the opposite lower side, the retaining device has a guide slot 16 for a coupling element 17 of the adjusting ring 6. As a coupling element 17, a cap screw fastened in the adjusting ring 6 is provided here purely by way of example.

Although the present invention has been fully described above on the basis of preferred exemplary embodiment, the present invention is not limited thereto, but may be modified in a variety of ways.

In particular, individual elements may be varied in shape and design. For example, a support bearing may be integrated into the useful section of a furniture or into a pedestal instead of being a separate bearing ring.

In addition, the blocking elements may have a different shape, provided that the engagement recesses correspond thereto and the resulting pairing is configured for rotational blocking of the axle 2. In particular, a design of the blocking elements 4 as balls would also be conceivable. Furthermore, pairings are also conceivable which provide axial fixing in addition to rotational fixing.

The actuating element 13 and the retaining device 14 may be configured in a variety of other ways, for example in the form of a different type of gear provided with an actuating element.

The number of corresponding engagement recesses 3, blocking elements 4, support bearings 5 and contoured recesses 7 may be varied in principle and may be provided in a number of one to a maximum arrangeable number limited by the installation space.

The invention claimed is:

1. A locking device for furniture, comprising:

an axle which is rotatable for adjusting the furniture and which has an engagement recess limited to a predetermined angular segment about the axle;

a blocking element which is configured for rotational blocking of the axle by engaging in the engagement recess;

a support bearing which is configured to support the blocking element in a fixed rotational manner about the axle; and an adjusting ring rotating about the axle, which has a contoured recess for radial adjustment of the blocking element within the support bearing upon rotation of the adjusting ring about the axle, wherein the blocking element is engageable in the engagement recess by the radial adjustment, so that the axle is lockable rotationally with the support bearing by means of the blocking element.

2. The locking device of claim 1, wherein the locking device is configured for furniture adjustable by rotation of a furniture section.

3. The locking device of claim 1, wherein the adjusting ring for radial adjustment of the blocking element in the direction of the axle is configured to be rotatably spring-biased, so that the blocking element may be independently latched to the engagement recess by the spring-biased rotation of the adjusting ring when the blocking element and the engagement recess are in register with one another.

4. The locking device of claim 1, wherein the contoured recess of the adjusting ring has an opening oriented towards the axle, through which the blocking element is engageable in the engagement recess at the level of the adjusting ring when the opening and the engagement recess are in register with one another.

5. The locking device of claim 4, wherein the blocking element is configured as a round bolt accommodated in the support bearing substantially parallel to the axle, and the engagement recess is configured as a round groove introduced into a lateral surface of the axle.

6. The locking device of claim 5, wherein a radius of the round bolt corresponds to a radius of the round groove, and in that the round bolt is configured to be insertable into the round groove over its entire length with a section of its circumferential surface.

7. The locking device of claim 1, wherein a plurality of engagement recesses, blocking elements, support bearings and contoured recesses of the adjusting ring arranged around the circumference of the axle are provided for radial adjustment of the blocking elements within the support bearings upon rotation of the adjusting ring.

8. The locking device of claim 7, wherein the arrangement of the plurality of engagement recesses, blocking elements, support bearings and contoured recesses is configured to be asymmetrically, distributed around the circumference of the axle, wherein only one single position is provided in which all blocking elements and the corresponding engagement recesses are in register with each other, so that the blocking elements are insertable into the engagement recesses only in this position by rotation of the adjusting ring.

9. A rotatable furniture, comprising:

a pedestal;

a useful section, in particular a seat; and a locking device comprising:

an axle which is rotatable for adjusting the furniture and which has an engagement recess limited to a predetermined angular segment about the axle;

a blocking element which is configured for rotational blocking of the axle by engaging in the engagement recess;

a support bearing which is configured to support the blocking element in a fixed rotational manner about the axle; and an adjusting ring rotating about the axle, which has a contoured recess for radial adjustment of the blocking element within the support bearing upon rotation of the adjusting ring about the axle, wherein the blocking element is engageable in the engagement recess by the radial adjustment, so that the axle is lockable rotationally with the support bearing by means of the blocking element, wherein the locking device couples the pedestal and the useful section by means of the axle and the support bearing of the locking device, and wherein the useful section is rotatable about the axle and lockable in a predetermined orientation relative to the pedestal by means of the locking device.

10. The rotatable furniture of Tim 9, wherein the rotatable furniture is a swivel chair.

11. The rotatable furniture of claim 10, wherein the furniture has an actuating element, which is configured to control the rotation or rotatability of the adjusting ring.

12. The rotatable furniture of claim 11, wherein the actuating element is configured as an adjusting lever.

13. The rotatable furniture of claim 11, wherein the adjusting ring for radial adjustment of the blocking element in the direction of the axle is configured to be rotatably spring-biased, so that the blocking element may be independently latched to the engagement recess by the spring-biased rotation of the adjusting ring when the blocking element and the engagement recess are in register with one another, and wherein a retaining device coupled to the actuating element is provided for selectively controlling the spring-biased rotatability of the adjusting ring.

14. The rotatable furniture of claim 13 wherein in a first position of the actuating element the adjusting ring is released for radial adjustment of the blocking element by the spring-biased rotation, and in a second position of the actuating element the retaining device blocks the adjusting ring against the spring bias in a position holding the blocking element out of engagement.

15. A method for locking a furniture which is adjustable by rotating a furniture section, comprising the method steps:

releasing the rotatability of an adjusting ring arranged about an axle of the rotatable furniture; and locking a blocking element, which is adjustable radially to the axle with a contoured recess of the adjusting ring, with an engagement recess, which is provided on the axle and is limited to a predetermined angular segment about the axle, by rotating the adjusting ring about the axle.

16. The method of claim 15, wherein the blocking element is supported in a rotationally secure manner about the axle by means of a support bearing, so that a rotational blocking of the axle with the support bearing is established by the engagement.

17. The method of claim 16, wherein the adjusting ring is spring-biased for independent rotation, and in that the blocking element and the engagement recess are brought into engagement with each other by independent rotation of the adjusting ring as soon as they come into alignment with each other.

18. The method of claim 17, wherein the engagement establishes a locking between a useful section, which is rotatable about the axle, and a pedestal of the furniture, wherein the useful section has an actuating element, by which the rotatability of the adjusting ring is released.

19. The method of claim 18, wherein the actuating element is configured as an actuating lever.

* * * * *